US005081449A

United States Patent [19]

Kurosu et al.

[11] Patent Number: 5,081,449

[45] Date of Patent: Jan. 14, 1992

[54] METHOD AND APPARATUS FOR DISPLAYING IMAGE INFORMATION

[75] Inventors: Yasuo Kurosu, Yokohama; Hidefumi Masuzaki, Hadano, both of Japan

[73] Assignee: Hitachi, Ltd., Tokyo, Japan

[21] Appl. No.: 331,295

[22] Filed: Mar. 31, 1989

[30] Foreign Application Priority Data

Apr. 1, 1988 [JP] Japan ..... 63-78015

[51] Int. Cl.[5] ..... G09G 1/06

[52] U.S. Cl. ..... 340/721; 340/706; 340/712; 395/155

[58] Field of Search ..... 340/706, 709, 710, 712, 340/721; 364/518, 519, 520, 521

[56] References Cited

U.S. PATENT DOCUMENTS

| | | | |
|---|---|---|---|
| 4,290,062 | 9/1981 | Marti et al. | 340/721 |
| 4,476,462 | 10/1984 | Feldman | 340/721 |
| 4,601,003 | 7/1986 | Yoneyama et al. | 340/721 |
| 4,831,556 | 5/1989 | Oono | 340/721 |
| 4,862,389 | 8/1989 | Takagi | 340/721 |

FOREIGN PATENT DOCUMENTS 59-26787 4/1984 Japan .

OTHER PUBLICATIONS

Suzuki et al., "Human Visual Characteristics in High Speed Browsing of Image Pages"; IEICE Technical Report; OS 86-16; pp. 83-89, 1986.

*Primary Examiner*—Ulysses Weldon
*Assistant Examiner*—M. Fatahiyar
*Attorney, Agent, or Firm*—Antonelli, Terry Stout & Kraus

[57] ABSTRACT

In image data display apparatus and method, code data stored in a memory is converted to image data, which is then cyclically stored into a plurality of image memories for displaying on a display as display data. Overrun of image screen which is caused by a difference between a recognition time and a response time of an operator when a continuous paging mode of the display for data retrieval is terminated is corrected by a hardware implemented circuit or a software implemented computer program so that a desired image screen is displayed.

30 Claims, 6 Drawing Sheets

METHOD AND APPARATUS FOR DISPLAYING IMAGE INFORMATION

BACKGROUND OF THE INVENTION

The present invention relates to a display circuit of an electronic filing apparatus having an optical disk, and more particularly to an image information display apparatus suitable for providing man-machine interface adapted for a high speed code expander.

When image data is displayed on a display of the electronic filing system, by using a display circuit having only one image memory as is the case in a conventional computer, an operator sees on the display a process of sequential overwriting of new image data on previous image data because of a low speed of code data expansion. Thus, the operator sees as if a leading edge of the image data under transfer repeatedly moves vertically from one line to other line on the display, and if the operators watch it, many of them have the uncomfortable feeling like light seasickness.

As means for solving the above problem, an apparatus disclosed in JP-A-59-26787 has been proposed.

FIG. 2 shows a simplified block diagram of a prior art apparatus. Numeral 21 denotes an optical disk which stores image data to be displayed, in a compressed status (code data); numeral 22 denotes a code expander for converting the code data to image data; numeral 23 denotes a selector for selecting one of two image memories in which the image data is to be written; numerals 24 and 25 denote image memories for storing the image data for display; numeral 26 denotes a selector for selecting one of the image data stored in the two image memories; which is to be displayed, numeral 27 denotes a timing signal generator for generating a horizontal synchronization signal and a vertical synchronization signal; numeral 28 denotes a CRT for displaying the image data in accordance with the timing signals; numeral 29 denotes an end of writing flag for indicating the end of conversion of the image data by the code expander 22 for each screen; and numeral 30 denotes an inverter for operating the two selectors 23 and 26 in the opposite phases.

The operation of the apparatus is now explained. The code data stored in the optical disk 21 is first read, and it is supplied to the code expander 22. In the code expander 22, the code data is decoded in accordance with an encoding rule, and it is converted into image data. The converted image data is supplied through the selector 23 to one of the two image memories 24 and 25 from which data is not outputted to the CRT 28.

On the other hand, the code expander 22 generates an end signal each time the process of the screen is finished, and supplies it to the end of writing flag 29. The end of writing flag 29 operates as a toggle switch, and it switches each time the process of one screen is completed. An output signal of the end of writing flag 29 is supplied to the selector 26 through the selector 23 and the inverter 30. The signal inverted by the inverter 30 is supplied to the two selectors 23 and 26 so that the two image memories 24 and 25 are allotted to writing and reading for each screen.

The image data is supplied from the read image memory 24 or 25 to the CRT through the selector 26. The CRT 28 displays the image data in accordance with the horizontal synchronization signal and the vertical synchronization signal supplied from the timing signal generator 27.

In the prior art apparatus described above, two image memories for storing the image data are alternately switched to display the image data.

Thus, even in an electronic filing apparatus having a low code expansion speed, the operator does not see if the leading line of the image data under transfer repeats the vertical movement, and the operator may continue paging without having the uncomfortable feeling.

In the prior art apparatus, however, since the end of one-screen processing signal of the code expander is used to switch the display screen, the screen switching time of the image data is determined by the code expansion time for one screen. As a result, independently of a response of the operator, the screen switching period is short if the expansion processing speed for the image data is high, and the switching period is long if the processing speed is low.

On the other hand, turning to the response of the operator to the display screen, it varies from two times to four times of a recognition time, depending on an individual. FIG. 3 shows a relation between a presentation time of the image data and an identification factor, and FIG. 4 shows a distribution of response times of operators to the image data. (M. Suzuki et al, "Study on Identification/Response Characteristic in High Speed Image Retrieval", The Institute of Electronics, Information and Communication Engineers (IEICE) Technical Report OS86-18, pp. 83–89, 1986). As seen from FIG. 3, approximately 0.2 second is required for the operator to recognize the display screen, and the time for recognition is independent of the complexity of the screen so long as the screen images are of the same type. Accordingly, an ideal screen switching period in the electronic filing apparatus is approximately 0.2 second. On the other hand, the response times are distributed between 0.2 second and 1.0 second and are concentrated between 0.4 second and 0.6 second. Thus, the response time is 2 to 3 times, or five times in an extreme case, as large as the recognition time. It is anticipated that the value may be somewhat higher when factors of working attitude and fatigue are taken into consideration. Accordingly, the response time is up to six times as large as the recognition time, depending on an individual.

In many of the existing electronic filing apparatus, the screen switching time is around two seconds, and even in a high performance apparatus, it is around one second. Accordingly, the display screen switching time is longer than the response time of the operator, and an overrun in which several screens have already been switched when the operator responses does not occur. However, the processing speed of the code expander has been increased year by year with the advancement of the image processing technology and the LSI technology, and it is now not impossible to attain the screen switching time of 0.2 second which is an ideal time.

Thus, as the code expansion speed is increased in the prior art apparatus which pays no attention to an overrun correction function in screen switching (screen paging) operation, the display screen may stop after several screens have been switched when the operator responses to stop the paging.

When the paging speed is increased as the LSI technology advances and the image processing speed is increased, an image information display apparatus which can flexibly comply with the overrun of the display screen due to the difference between the recognition time and the response time of the operator is required.

SUMMARY OF THE INVENTION

It is an object of the present invention to provide image information display technology which permits correction of an overrun of a display screen due to a difference between a recognition time and a response time of an operator.

In order to achieve the above object, the image information display apparatus in accordance with the technique of the present invention comprises a code expander and a CRT which are essential to display image information as well as a plurality of image memories for storing a plurality of display screen data to be successively displayed, means for allowing the operator to set a return count, and means for displaying the data of that image memory which is behind, by the return count, the image memory whose data is displayed in the overrun status when the operator enters a stop command.

In the present invention, the above means for correcting the overrun may be implemented by hardware by using an electronic circuit, or it may be implemented by software by using a computer program partially or totally.

Where the present invention is implemented by the hardware, the image information display apparatus of the present invention comprises a ring counter for cyclically activating the image memories and a subtractor for calculating the return count for the display screen in response to an input from the operator such as a keyboard. The display screen is shifted back by the necessary count to correct the overrun when the continuous paging operation is stopped. A read controller for the image memories has a selector so that one of the image memory specified by the ring counter and the image memory specified by the subtractor is displayed.

In the continuous paging mode, the count of the ring counter is read and transferred to the read selector. An incremented count through an incrementer is transferred to the write selector. When those counts are supplied to the respective selectors, the access to the image memories specified by those counts is started, and the content of the image memory specified by the count of the ring counter is displayed on the display. At the end of decoding of the next image data, the count of the ring counter is incremented so that the control is shifted to the image memory of the next address and the image of the next page is displayed. Since the write screen specified is one screen ahead of the read screen, the write operation and the read operation do not conflict on one image memory, and stable continuous paging is attained.

When the operator finds desired image data in the course of continuous paging, the operator enters from the keyboard a stop command and a return count for the screen to correct the overrun. (The return count may be previously entered by the operator from the keyboard. Where the stop command and the return count are to be simultaneously entered, one of ten keys may be depressed so that the stop command and the return count corresponding to the number of the depressed key are simultaneously entered.) When the stop command is entered, the selector of the controller selects the output of the subtractor instead of the output of the ring counter, and the address of the image memory equal to the difference between the count of the ring counter and the return count is produced. That is, the return number is subtracted from the address of the display memory whose content is displayed in the overrun status so that the address of the image memory which was present on the display screen when the operator decided to stop the display screen is produced. The image data stored in the specified image memory is supplied to the display through the read selector. The display displays the screen which was on display when the operator decided to stop, instead of the overrun screen. During this period, the writing to the image memory is inhibited until the next continuous paging command is issued.

The image memories may be dynamic RAMs or static RAMs. Any plural number of image memories may be used. In practice, 4–8 image memories are preferable.

The image information display technique of the present invention may be implemented by a computer program. Various configuration may be used in applying the computer program to the image information display apparatus of the present invention. The ring counter, subtractor and selectors of the hardware implemented image information display apparatus of the present invention are partially or totally replaced by the computer program, and the image memories and CRT are controlled by the computer program.

In accordance with the present invention, the image is displayed with the correction of the overrun of the display screen due to the difference between the recognition time and the response time of the operator. In accordance with the present invention, an image information display apparatus having good man-machine interface is provided.

DESCRIPTION OF THE PREFERRED EMBODIMENTS

Preferred embodiments of the present invention are now explained with reference to the accompanying drawings.

Figure 1:
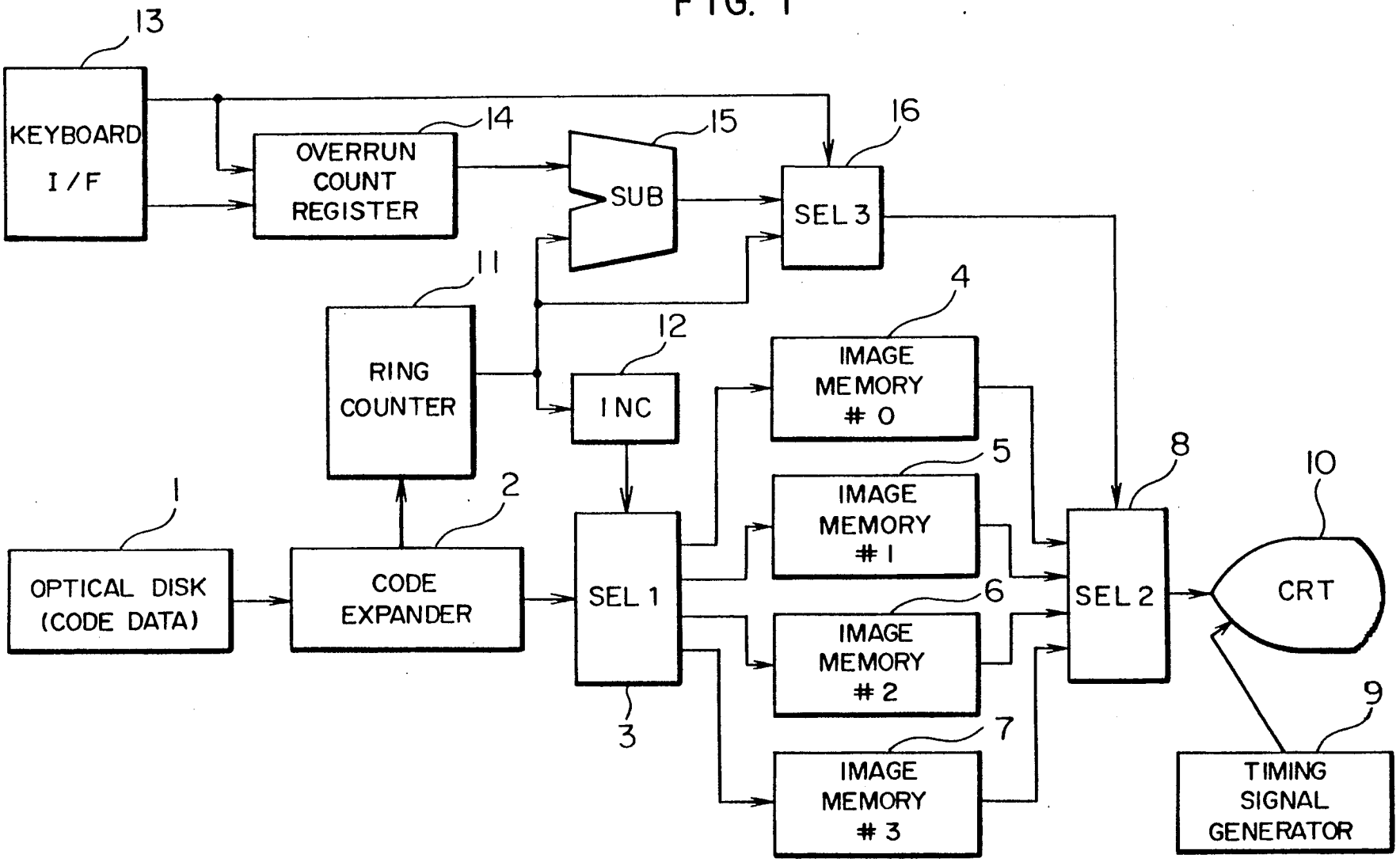
FIG. 1 shows a block diagram of one embodiment of an image information display apparatus of the present invention.

FIG. 1 shows a block diagram of one embodiment of the present invention. Numeral 1 denotes an optical disk which stores several tens of pages of image data in a code form; numeral 2 denotes a code expander which decodes code data read from the optical disk to image data; numeral 3 denotes a first selector for selecting one of four image memories 4–7 into which the expanded data is to be written; numerals 4–7 denote image memory in which image data are cyclically stored for displaying on a CRT 10; numeral 8 denotes a second selector for selecting one of image data stored in the four image memories 4–7 which is to be displayed; numeral 9 denotes a timing signal generator for generating a horizontal synchronization signal and a vertical synchronization signal for the CRT 10; numeral 10 denotes the CRT for displaying the image data in accordance with the signal generated by the timing signal generator 9; numeral 11 denotes a ring counter for cyclically activating the plurality of (four in FIG. 1) image memories 4–7; numeral 12 denotes an incrementer for controlling the write image screen of the four image memories 4–7, one image screen ahead of the read image screen; numeral 13 denotes a keyboard interface (I/F) for accepting a stop command by an operator to the continuous paging and the number of return image screens (number of overrun image screens); numeral 14 denotes an overrun count register for holding the number of return image screens supplied from the keyboard I/F 13; numeral 15 denotes a subtractor which subtracts the contents of the overrun count register from the count of the ring counter 11 in order to select the return image screen from the four image memories 4–7; and numeral 16 denotes a third selector which selects the output of the subtractor 15 at the stop mode and selects the output of the ring counter 11 in the continuous paging mode in accordance with the control signal from the keyboard I/F 13.

The operation of the present embodiment is now described. The compressed code data stored in the optical disk 1 is read and supplied to the code expander 2. The image data supplied from a scanner is compressed before it is stored in the optical disk 1 in order to increase the number of images stored in the optical disk 1. The electronic filing apparatus usually uses the MH coding system or MR or MMR coding system which are the CCITT standard adapted in a FAX in order to facilitate exchange of data through a public line. The code expander 2 decodes the input code data in accordance with the coding rule, and it is converted to the image data. The converted image data is supplied through the first selector 3 to one of the image memories 4–7 which has the address which is one larger than the count of the ring counter 11.

The code expander 2 decodes the code data as well as generates an end signal each time the decoding of one image screen is completed and supplies it to the ring counter 11. When the ring counter 11 receives the end signal, it is incremented, and one of the image memories 4–7 which has the address equal to the count of the ring counter 11 is selected through the third selector 16 and the second selector 8. When the image memory having the address equal to the count of the ring counter is selected, the image data to be next displayed is supplied to the CRT 10 through the second selector 8. When the CRT 10 receives the image data for the next image screen, it displays the image data on the screen in accordance with the horizontal synchronization signal and the vertical synchronization signal supplied from the timing signal generator 9. In the present embodiment, the ring counter is counted up 0→1→2→3→0→1, and the second selector 8 for the read data selectively displays the image memories #0→#1→#2→#3→#0→#1. The first selector 3 for the write data selects the image memories #1→#2→#3→#0→#1→#2 through the incrementer 12. Since the write image screen is designated one image screen ahead, the write operation and the read operation do not compete on one image memory and stable continuous paging is attained.

A plurality of image data decoded by the code expander 2 may be collectively written into the image memory, or the image data may be written into the image memory each time one image screen of image data is decoded by the code expander 2.

On the other hand, when the operator finds desired image data in the course of the continuous paging, the operator sends the stop command and the return image count which is unique to the operator to the keyboard I/F 13. It has been well known that a response time to the display screen has a significant difference from operator to operator but it has no substantial change in time. Thus, the operator need not specify a different return count from time to time and hence a relatively good man-machine interface can be maintained. Thus, the return count may be assigned to a ten-key or a function key on the keyboard so that appropriate command is given to the image information display apparatus by the depression of the assigned key. When the keyboard I/F 13 receives the stop command and the return count for the display screen, it sends the return count to the overrun count register and switches the input of the third selector 16 from the ring counter 11 to the subtractor 15. The overrun count register 14 holds the return count until the next command is issued and supplies the count to the subtractor 15. The subtractor 15 subtracts the return count from the address of the image memory 4–7 whose content is being displayed on the CRT 10 by the overrun to calculate the address of the image memory which was present when the operator decided to stop the display screen. Namely, the count of the overrun count register 14 is subtracted from the count of the ring counter 11, and the difference is supplied to the second selector 8 through the third selector 16. The second selector 8 reads out the image memory 4–7 having the address equal to the difference and supplies the image data thereof to the CRT 10. The CRT 10 thus displays the image which was present when the operator decided to stop the display screen, in place of the overrun image screen.

Finally, when the stop mode is to be released and the continuous paging mode is to be started, the input to the third selector 16 is switched from the output of the subtractor 15 to the output of the ring counter 11 by a command from the keyboard I/F 13. Thus, the circuit status is reset to the original state, and the stable continuous paging is resumed. While four image memories are shown in the present embodiment, any plurality of number of image memories may be used. In actual, four to eight image memories may be appropriate from the standpoint of recognition and response characteristic of a human being.

In the present embodiment, the incrementer which controls the write image screen to be one image screen ahead of the read image screen is used. Alternatively, a decrementer which controls the read image screen to be one image screen behind the write image screen may be used.

Another embodiment of the present invention implemented by computer software is now explained.

The essential hardware components of the present invention are optical disks 1 and 21 for storing the code data, code expanders 2 and 22 for converting the code data to the image data, image memories 4, 5, 6, 7, 24 and 25 for temporarily storing the image data, CRT's 10 and 28 for displaying the image data and timing signal generators 9 and 27 for synchronizing the CRT's 10 and 28. The other hardware components such as the subtractor 15 shown in FIGS. 1 and 2 are means for controlling the above essential components, and they may be replaced by computer software.

Figure 2:
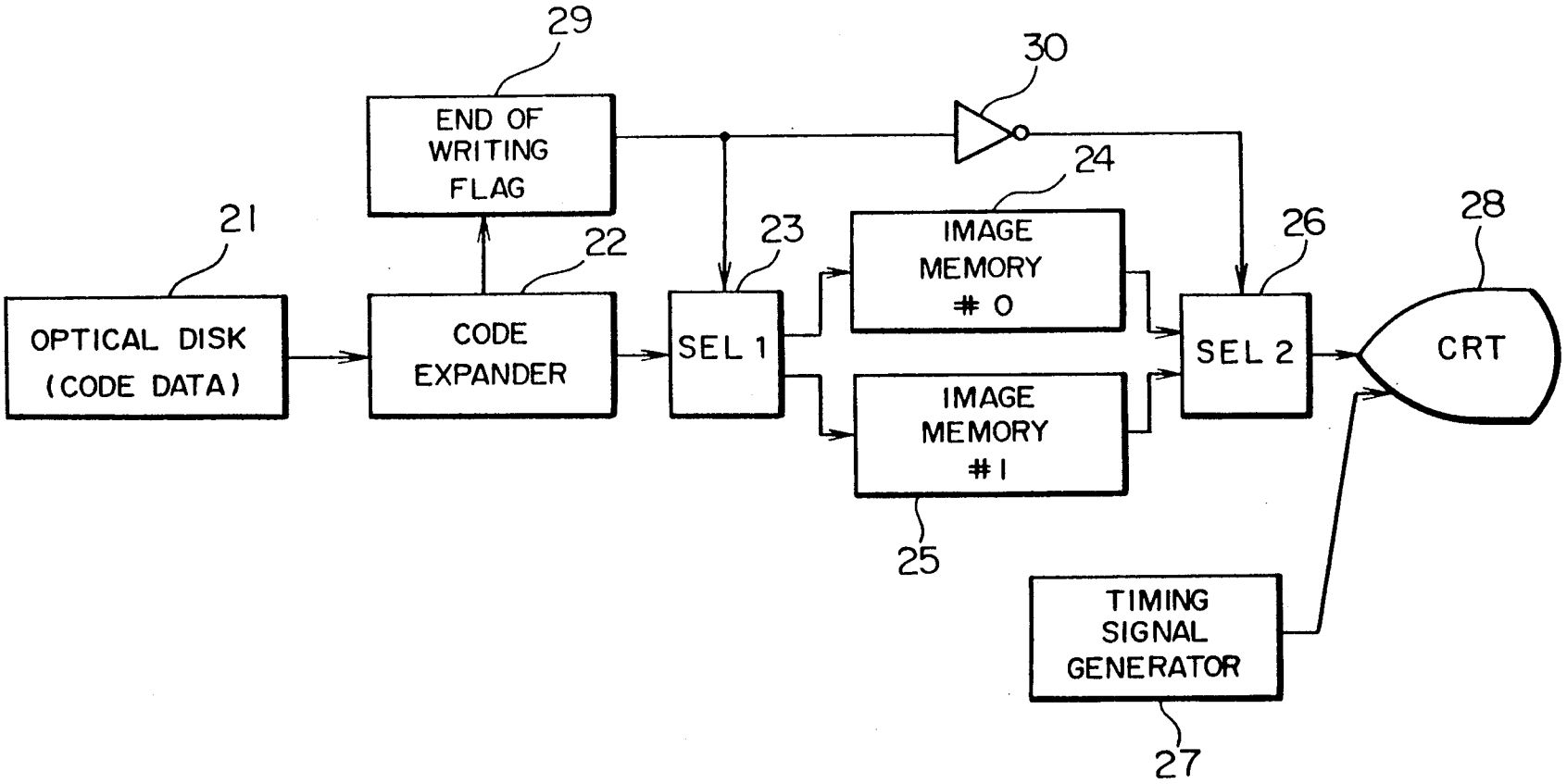
FIG. 2 PRIOR ART
FIG. 2 shows a block diagram of a prior art image information display apparatus.
Figure 3:
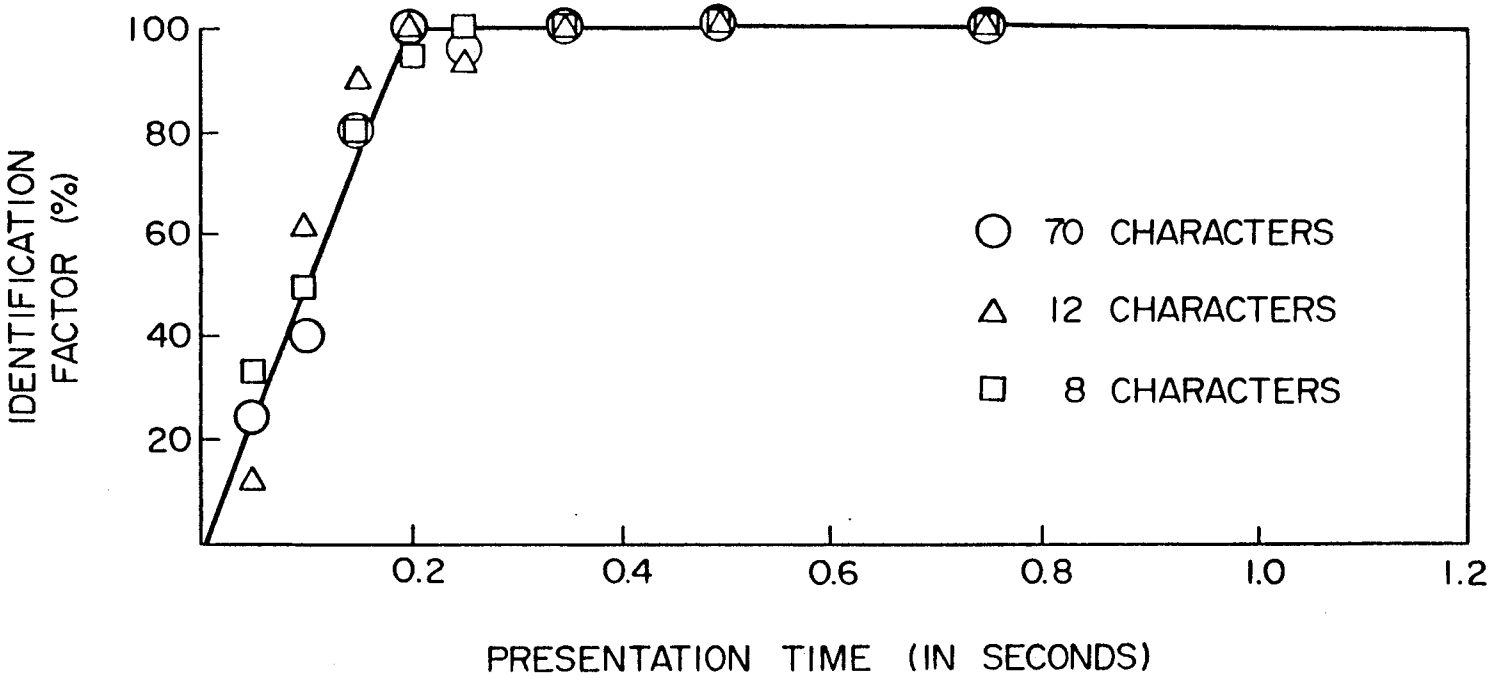
FIG. 3 shows a relation between a presentation time of image data and an identification factor of an operator.
Figure 4:
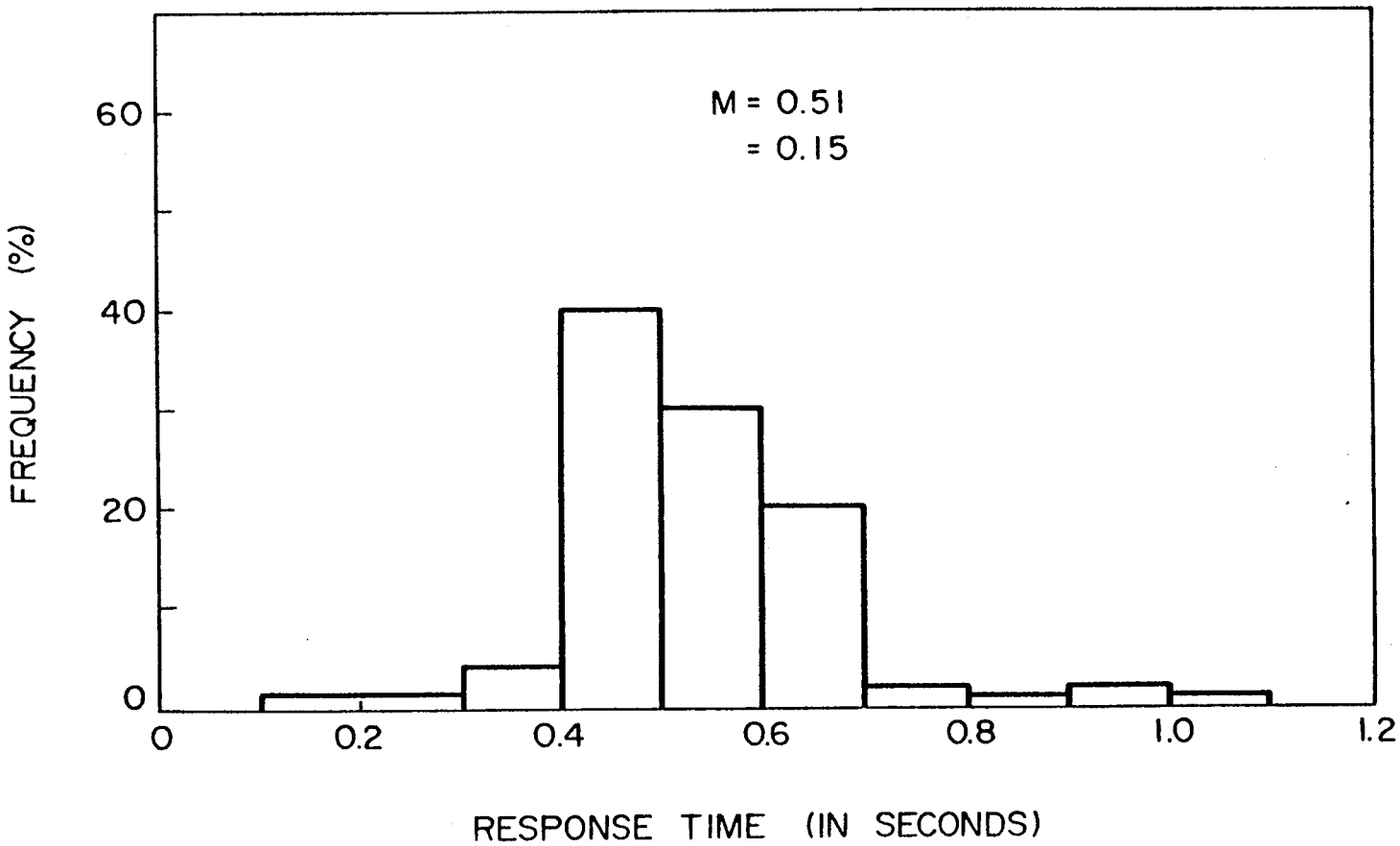
FIG. 4 shows a distribution of response times of operators to image data.

Thus, the present invention may be attained by adding computer software to a conventional image information display apparatus shown in FIG. 2.

A combination of the conventional image information display apparatus shown in FIG. 2 and the computer software is now explained as a second embodiment of the present invention.

Figure 5:
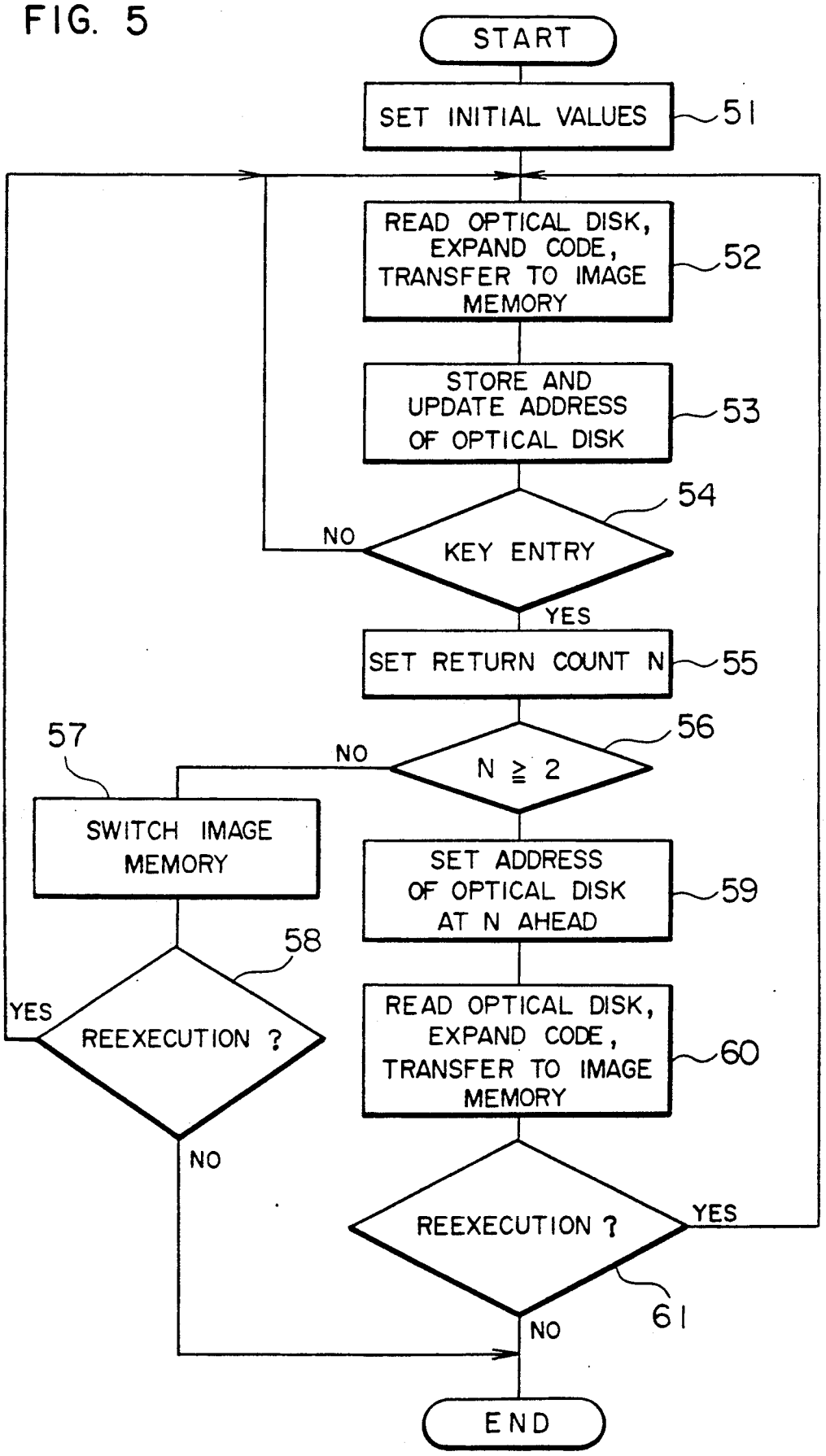
FIG. 5 shows a flow chart of a second embodiment of the present invention implemented by a computer program.

FIG. 5 shows a flow chart for illustrating means for attaining the present invention by the known hardware shown in FIG. 2 and the software.

In a block 51 of FIG. 5, an initial value such as an address of image to be displayed of the optical disk 21 is set. In a block 52, the code data stored in the optical disk 21 is read; the image data is generated in the code expander 22, and it is sent to one of the image memories 24 and 25. The transferred image data is displayed on the CRT 28. In a block 53, the address of the read code data on the optical disk 21 is recorded, and the address of the next page is updated in order to return the image screen.

In a block 54, whether the above sequence is to be repeated or not is determined. If there is no key entry, the process returns to the block 52 and the image of the next page is displayed. If there is a key entry, the process departs from the above sequence and proceeds to the following process.

In a block 55, the return count entered in the block 55 is set. The return count may be entered by a ten-key, or it may be entered as an initial value in the block 51. In a block 56, whether the image to be displayed is in the image memory 24 or 25 or in the optical disk 21 is determined. If it is the previous page, it should have been stored in one of the image memories 24 and 25, and if it is the page before the previous page, it should have been stored in the optical disk 21.

When the return count N is "1", a block 57 is carried out. The selector 23 between the image memories 24 and 25 and the CRT 28 is switched to display the image of the previous page. In a block 58, whether it is reexecution or not is determined. If it is reexecution, the process returns to the block 52 and if it is not the reexecution, the process is terminated.

When the return count N is equal to or larger than "2", a block 59 is carried out. The address of the corresponding image on the optical disk 21 is set. This address is generated based on the information stored in the block 54. In a block 60, a similar process to that of the block 53 is carried out, and a desired image is displayed on the CRT 28.

Finally, in a block 61, whether it is reexecution or not is determined. If it is the reexecution, the process returns to the block 52, and if it is not the reexecution, the process is terminated.

In this manner, the present invention is implemented by the software in the second embodiment.

However, since the second embodiment is provided with only two image memories, there is a limitation in performance.

A third embodiment which has a plurality of image memories is now explained.

Figure 6:
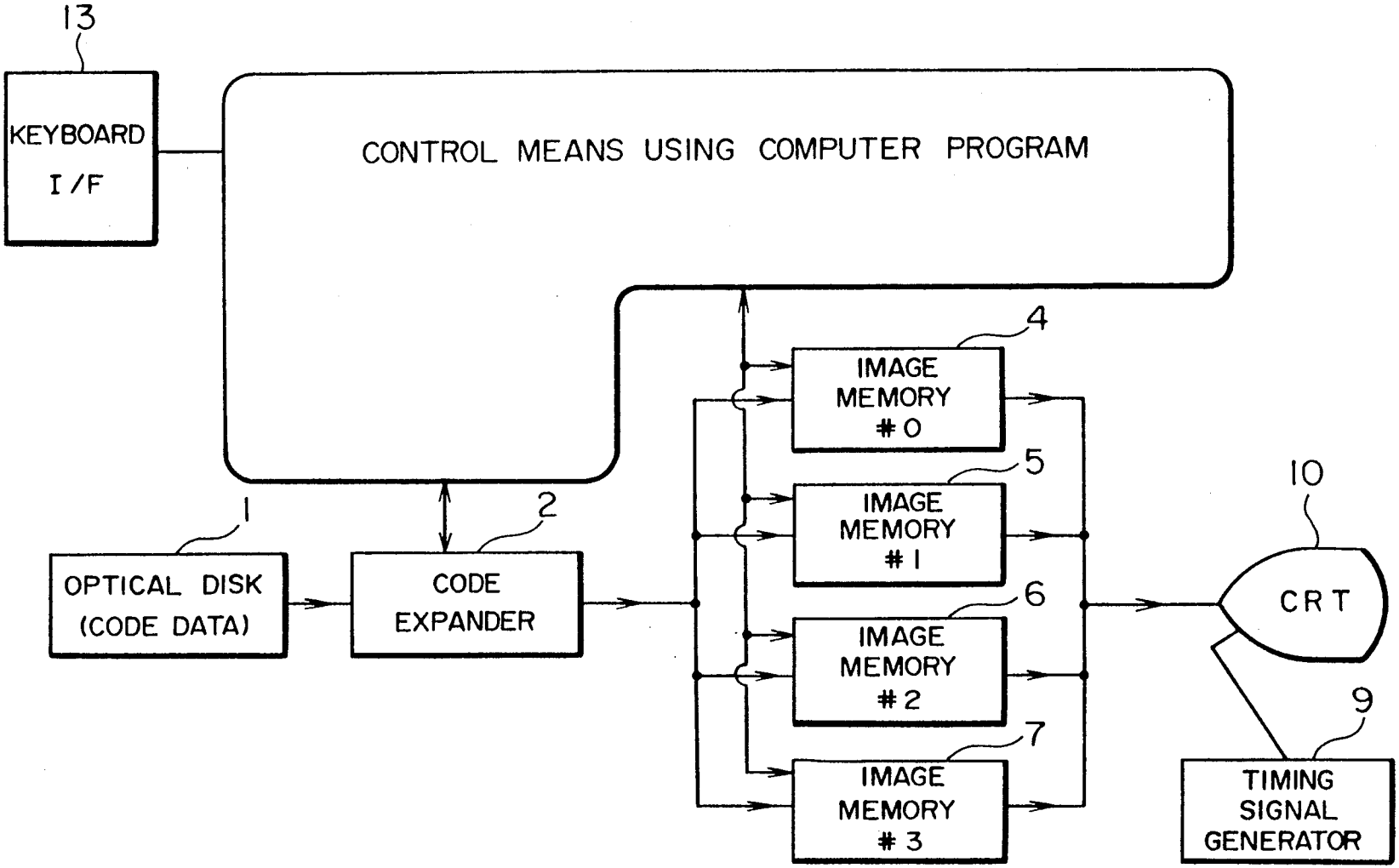
FIG. 6 shows a block diagram of a third embodiment of the image information display apparatus of the present invention implemented by a computer program.

The present invention is attained by replacing the image information display apparatus of the first embodiment shown in FIG. 1 by computer software. In this embodiment, the advantages offerred by the image information display apparatus of FIG. 1 are attained as they are. FIG. 6 shows the embodiment in which the computer software is replaced in the image information display apparatus of FIG. 1. The optical disk 1, code expander 2, image memories 4, 5, 6 and 7 and CRT 10 are directly controlled by the computer software. A portion of the apparatus of FIG. 1 including the selectors 3, 8 and 16 may be left remained and the remaining components may be controlled by the computer software.

In the above embodiments, the optical disk is used. However, the storage is not limited to the optical disk but other storage such as magnetic tape or magnetic disk may be used in the present invention.

In the above embodiments, the code expander is used as the code data conversion means. However, any means for converting the code data to the image data may be used in the present invention.

Thus, the continuous paging speed attains an ideal speed (0.2 second/page) as the display technology including the image processing technology and the LSI technology advance and the overrun of the display screen occurs due to the difference between the recognition time and the response time of the operator. However, such an overrun can be flexibly corrected with good man-machine interface.

In accordance with the present invention, the display circuit of the electronic filing apparatus having the optical disk is provided with the ring counter for cyclically activating the plurality of image memories and the subtractor for calculating the return count of the display screen in response to the input from the operator through the keyboard so that the overrun image screen may be returned when the continuous paging is stopped. In this manner, the overrun of the image screen due to the delay of response of the operator to the continuous paging speed can be readily corrected, and the present invention offers a great advantage in the electronic filing apparatus which requires a good man-machine interface.

In the prior art apparatus, the problem of overrun of the display screen was not seriously considered because the display speed was low. However, as the image processing technology, LSI technology and display technology advance in recent years, the improvement in the display speed in such an apparatus is remarkable and the real value of the present invention will be surely testified very shortly.

We claim:

1. An image information display apparatus comprising:

image data memory means comprising a plurality of image memories for receiving and storing image data as a plurality of display screens;

image display means for displaying said plurality of display screens on a display;

control means for correcting an overrun of at least two display screens and controlling said image data memory means and said image display means to display a first display screen of said plurality of display screens recognized by an operator during a continuous paging of said plurality of display screens, said continuous paging being terminated by a stop signal, said first display screen being displayed next after the termination of the continuous paging.

2. An image information display apparatus according to claim 1 wherein said plurality of image memories comprises at least four image memories and no more than eight image memories.

3. An image information display apparatus according to claim 1 wherein said control means includes a computer for controlling said image data memory means and said image display means by a computer program.

4. An image information display apparatus as in claim 1 wherein said memory is an optical disk.

5. An image display apparatus as in claim 1, said control means further comprises an incrementer to control the plurality of display screens being received by said plurality of image memories such that the display screen being written into said plurality of image memories is one display screen ahead of the display screen which is read from said plurality of image memories.

6. An image display apparatus as in claim 1, said control means further comprises a decrementer to control the plurality of display screens being received by said plurality of image memories such that the display screen being read from said plurality of image memories is one display screen behind the display screen which is written into said plurality of image memories.

7. An image information display apparatus as in claim 1 wherein said stop signal corresponds to a response of the operator.

8. An image data display method comprising the steps of:

converting code data stored in a memory into image data;

storing the image data into a plurality of image memories as a plurality of display screens, each of said plurality of image memories corresponding to a display screen of said plurality of display screens wherein said image data is sequentially displayed on a display during a continuous paging of said plurality of display screens for an image search; and displaying a first display screen of said plurality of display screens recognized by an operator during said continuous paging of said plurality of display screens to correct an overrun of at least two display screens, when said continuous paging is terminated, said first display screen being displayed next after the termination of the continuous paging.

9. An image data display method comprising the steps of:

expanding code data stored in a memory into image data;

storing the image data into a plurality of image memories as a plurality of display screens, each of said plurality of image memories corresponding to a display screen of said plurality of display screens wherein said image data is sequentially displayed on a display during a continuous paging of said plurality of display screens for an image search; and displaying a first display screen of said plurality of display screens recognized by an operator during said continuous paging of said plurality of display screens to correct an overrun of at least two display screens, when said continuous paging is terminated, said first display screen being displayed next after the termination of the continuous paging.

10. An image information display apparatus comprising:

image data memory means including a plurality of image memories for storing image data sequentially as a plurality of display screens;

image display means for sequentially displaying said image data read from said plurality of image memories on a display during a continuous paging of said plurality of display screens;

image display stop means for terminating the continuous paging of said plurality of display screens by said image display means by a command of an operator and for displaying a first display screen of said plurality of display screens designated by the operator;

display correction means for displaying said first display screen which are designated by switching to a specified position of said image data, said specified position corresponding to image data recognized by said operator and for correcting an overrun of at least two display screens due to a difference period of time between a recognition time and a response time of an operator, said first display screen being displayed next after the termination of the continuous paging.

11. An image information apparatus according to claim 10, wherein said display correction means comprises a control apparatus, said specified position being a received value received from the control apparatus.

12. An image information apparatus according to claim 10, wherein said display correction means comprises a control apparatus, said specified position being a calculated value calculated in said control apparatus, said calculated value being calculated from a predetermined value corresponding to an input of an operator.

13. An image information display apparatus comprising:

code data expansion means for reading code data from a memory and expanding the code data to image data;

image data memory means comprising a plurality of image memories for receiving and storing the image data as a plurality of display screens;

image display means for displaying said plurality of display screens on a display;

control means for correcting an overrun of at least two display screens and controlling said code data expansion means, said image data memory means and said image display means to display a first display screen of said plurality of display screens recognized by an operator during a continuous paging of said plurality of display screens, said continuous paging being terminated by a stop signal, said first display screen being displayed next after the termination of the continuous paging.

14. An image information display apparatus according to claim 13 wherein said plurality of image memories comprises at least four image memories and no more than eight image memories.

15. An image information display apparatus according to claim 13 wherein said plurality of image memories are dynamic RAM memory.

16. An image information display apparatus according to claim 13 wherein said plurality of image memories are static RAM memory.

17. An image information display apparatus according to claim 13 wherein said control means includes a computer for controlling said code data expansion means, said image data memory means and said image display means by a computer program.

18. An image information display apparatus according to claim 13 wherein as said code data expansion means reads the code data from the memory and expands the code data into one display screen of the plurality of data screens, said image data memory means cyclically stores a display screen of said plurality of display screens into one image memory of said plurality of image memories.

19. An image information display apparatus according to claim 13 wherein after said code data expansion means has read the code data from the memory and expanded the code data into said plurality of display screens of image data, said image data memory means cyclically stores the plurality of display screens of image data into said plurality of image memories.

20. An image information display apparatus comprising:

image data memory means comprising a plurality of image memories for receiving and storing image data as a plurality of display screens;

image display means for displaying said plurality of display screens on a display;

control means for correcting an overrun of said plurality of display screens and controlling said image data memory means and said image display means to display a first display screen of said plurality of display screens recognized by an operator during a continuous paging of said plurality of display screens, said first display screen being displayed next after the termination of the continuous paging, said continuous paging being terminated by a stop signal;

wherein said control means includes a ring counter for cyclically actuating said plurality of image memories and a subtractor for receiving a return count from the control means in response to said stop signal.

21. An image display apparatus as in claim 20 wherein said control means further comprises:

selector means for switching a selector for selecting said plurality of image memories such that said subtractor activates said plurality of image memories.

22. An image display apparatus as in claim 20 wherein said ring counter generates a ring count corresponding to one of said plurality of image memories being activated, said subtractor receiving said ring count and subtracting said return count from said ring count to obtain a different count corresponding to the first display screen recognized by the operator.

23. An image display apparatus as in claim 21 wherein said selector means further includes restart means to switch said selector such that said ring counter activates said plurality of image memories and activates said continuous paging beginning from a second display screen displayed when said stop signal was received.

24. An image information display apparatus as in claim 22 wherein said return count corresponds to an input of the operator.

25. An image information display apparatus as in claim 24 wherein said return count is a predetermined count and corresponds to said input of the operator.

26. An image information display apparatus as in claim 25, wherein said return count is inputted during a response of the operator to the recognition of the first display screen.

27. An image information display apparatus comprising:

code data expansion means for reading code data from a memory and expanding the code data to image data;

image data memory means comprising a plurality of image memories for receiving and storing the image data as a plurality of display screens;

image display means for displaying said plurality of display screens on a display;

control means for correcting an overrun of said plurality of display screens and controlling said code data expansion means, said image data memory means and said image data means to display a first display screen of said plurality of display screens recognized by an operator during a continuous paging of said plurality of display screens, said first display screen being displayed next after the termination of the continuous paging, said continuous paging being terminated by a stop signal;

wherein said control means includes a ring counter for cyclically actuating said plurality of image memories and a subtractor for receiving a return count from the control means in response to said stop signal.

28. An image information display apparatus according to claim 27 wherein said control means includes a first selector for selecting one of said plurality of image memories into which the image data which was expanded from said code data is written; a second selector for selecting a display screen from said plurality of image memories; and a third selector for selecting the output of said subtractor when the continuous paging of said plurality of display screens is stopped and selecting the output of said ring counter during the continuous paging.

29. An image information display apparatus according to claim 27 wherein said control means includes an incrementer for controlling a write image screen of said plurality of display screens to be one display screen ahead of a read image screen of said plurality of display screens.

30. An image information display apparatus according to claim 27 wherein said control means includes a decrementer for controlling a read image screen of said plurality of display screens to be one display screen behind a write image screen of said plurality of display screens.

* * * * *